US011101065B2

(12) United States Patent
Yoon et al.

(10) Patent No.: US 11,101,065 B2
(45) Date of Patent: Aug. 24, 2021

(54) ELECTRONIC COMPONENT

(71) Applicant: SAMSUNG ELECTRO-MECHANICS CO., LTD., Suwon-si (KR)

(72) Inventors: Ji Sook Yoon, Suwon-si (KR); Sang Ho Shin, Suwon-si (KR); Byung Kug Cho, Suwon-si (KR); Sung Jin Park, Suwon-si (KR); Jae Wook Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 210 days.

(21) Appl. No.: 16/054,269

(22) Filed: Aug. 3, 2018

(65) Prior Publication Data

US 2019/0096568 A1 Mar. 28, 2019

(30) Foreign Application Priority Data

Sep. 22, 2017 (KR) ..... 10-2017-0122324

(51) Int. Cl.
*H01F 5/00* (2006.01)
*H01F 27/29* (2006.01)
(Continued)

(52) U.S. Cl.
CPC ..... *H01F 27/292* (2013.01); *H01F 17/0013* (2013.01); *H01F 17/0033* (2013.01); *H01F 17/04* (2013.01); *H01F 27/2828* (2013.01); *H01F 27/306* (2013.01); *H01F 2017/048* (2013.01)

(58) Field of Classification Search
None
See application file for complete search history.

(56) References Cited

U.S. PATENT DOCUMENTS

2012/0188682 A1* 7/2012 Sato ..... H01G 4/232 361/305
2012/0274432 A1 11/2012 Jeong et al.
(Continued)

FOREIGN PATENT DOCUMENTS

CN 102760553 A 10/2012
CN 103180919 A 6/2013
(Continued)

OTHER PUBLICATIONS

English translation of JP2007305830 (Year: 2007).*
(Continued)

*Primary Examiner* — Ronald Hinson
(74) *Attorney, Agent, or Firm* — Morgan, Lewis & Bockius LLP

(57) ABSTRACT

An electronic component includes a body having an internal electrode disposed therein, and an external electrode disposed on the body and connected to the internal electrode, wherein in a cross section of the body cut in length and thickness directions, the external electrode includes a first electrode layer disposed below the body and a second electrode layer covering at least the first electrode layer and a side portion of the body, and the internal electrode is connected to the second electrode layer through the side portion of the body.

20 Claims, 8 Drawing Sheets

(51) Int. Cl.

| | |
|---|---|
| ***H01F 17/04*** | (2006.01) |
| ***H01F 17/00*** | (2006.01) |
| ***H01F 27/30*** | (2006.01) |
| ***H01F 27/28*** | (2006.01) |

(56) References Cited

U.S. PATENT DOCUMENTS

| | | | | |
|---|---|---|---|---|
| 2013/0222101 | A1 | 8/2013 | Ito et al. | |
| 2014/0292470 | A1* | 10/2014 | Yokoyama | H01F 27/292 336/200 |
| 2015/0014038 | A1 | 1/2015 | Park et al. | |
| 2016/0086714 | A1* | 3/2016 | Moon | H01F 17/0013 336/192 |
| 2016/0141093 | A1* | 5/2016 | Jeong | H01F 17/0013 336/200 |
| 2016/0217920 | A1 | 7/2016 | Choi et al. | |
| 2016/0225517 | A1* | 8/2016 | Choi | H01F 17/0013 |
| 2016/0268038 | A1* | 9/2016 | Choi | H01F 27/255 |
| 2016/0276089 | A1* | 9/2016 | Inoue | H01F 41/046 |
| 2016/0343506 | A1 | 11/2016 | Lee et al. | |

FOREIGN PATENT DOCUMENTS

| | | | |
|---|---|---|---|
| CN | 105957692 | A | 9/2016 |
| JP | 2007-305830 | A | 11/2007 |
| JP | 2016-139789 | A | 8/2016 |
| KR | 10-1508539 | B1 | 4/2015 |
| KR | 10-1607027 | B1 | 3/2016 |
| KR | 10-1630037 | B1 | 6/2016 |
| KR | 2016-0108935 | A | 9/2016 |

OTHER PUBLICATIONS

Korean Office Action dated Oct. 8, 2018 issued in Korean Patent Application No. 10-2017-0122324 (with English translation).

Office Action issued in corresponding Chinese Patent Application No. 201811079019.4 dated Apr. 17, 2020, with English translation.

* cited by examiner

ELECTRONIC COMPONENT

CROSS-REFERENCE TO RELATED APPLICATION

This application claims benefit of priority to Korean Patent Application No. 10-2017-0122324 filed on Sep. 22, 2017 in the Korean Intellectual Property Office, the disclosure of which is incorporated herein by reference in its entirety.

BACKGROUND

1. Field

The present disclosure relates to an electronic component such as a coil component.

2. Description of Related Art

As numbers of components are increased in accordance with performance improvements of electronic devices, it has become necessary to solve the problem of insufficiency of a mounting space and decreased electrical noise. In order to solve the problem of insufficiency of the mounting space and to improve electrical characteristics of a circuit, technology for surface-mounting a passive component very adjacently to an integrated circuit (IC) and packaging the passive component and the IC as a single module and making a package an on-chip form has been required.

Meanwhile, at the time of manufacturing an IC package, a printed circuit board (PCB) and an inductor are molded using an epoxy molding compound (EMC) in many cases. In this case, the molded EMC may absorb moisture from the atmosphere to include a predetermined amount of moisture. The moisture is expanded while being rapidly vaporized when it is exposed to a soldering process (temperature of 220° C. to 260° C.), and in a case of an inductor having a large length in a longitudinal direction, the possibility that an internal crack will occur in the inductor due to contraction and expansion of the EMC is increased.

SUMMARY

An aspect of the present disclosure may provide an electronic component of which an interface close adhesion in a package between a package and a printed circuit board is improved by changing a structure of an external electrode.

According to an aspect of the present disclosure, an electronic component may be provided, in which a structure of an external electrode is changed to be different from that of the related art.

According to an aspect of the present disclosure, an electronic component may include a body having an internal electrode disposed therein, and an external electrode disposed on the body and connected to the internal electrode, wherein in a cross section of the body cut in length and thickness directions, the external electrode includes a first electrode layer disposed below the body and a second electrode layer covering at least the first electrode layer and a side portion of the body, and the internal electrode is connected to the second electrode layer through the side portion of the body.

According to another aspect of the present disclosure, an electronic component may include a magnetic body having first and second surfaces opposing each other in a first direction, third and fourth surfaces opposing each other in a second direction, and fifth and sixth surfaces opposing each other in a third direction, a winding type coil disposed in the magnetic body and having a first lead terminal led out to the first surface and a second lead terminal led out to the second surface, a first electrode layer formed on the fifth surface, a second electrode layer covering the first electrode layer and extended to at least the first surface; a third electrode layer formed on the fifth surface to be spaced apart from the first electrode layer, and a fourth electrode layer covering the third electrode layer and extended to at least the second surface, wherein the first lead terminal is connected to the second electrode layer through the first surface, and the second lead terminal is connected to the fourth electrode layer through the second surface.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
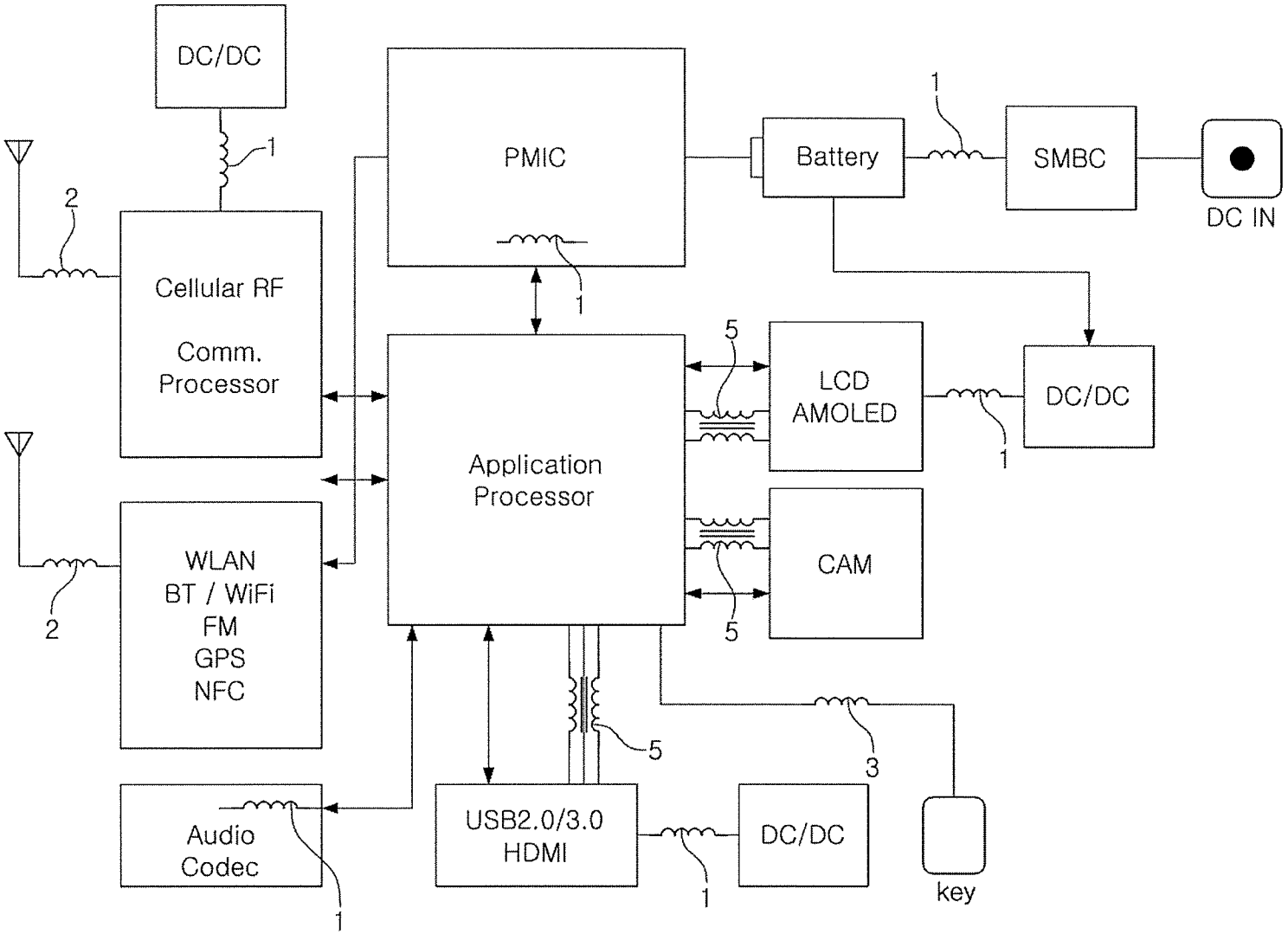
FIG. 1 is a schematic view illustrating an embodiment of a coil component used in an electronic device.

Hereinafter, exemplary embodiments in the present disclosure will be described in more detail with reference to the accompanying drawings. In the drawings, shapes, sizes, and the like, of components may be exaggerated for clarity.

The meaning of a "connection" of a component to another component in the description includes an indirect connection through an adhesive layer as well as a direct connection between two components. In addition, "electrically connected" conceptually includes a physical connection and a physical disconnection. It can be understood that when an element is referred to with terms such as "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element. That is, even though any component is called a first component in the specification, it is not necessarily called the first component in the claims, and the scope of the present disclosure is also not limited thereto.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with one another. For example, one element described in a particular exemplary embodiment, even if it is not described in another exemplary embodiment, may be understood as a description related to another exemplary embodiment, unless an opposite or contradictory description is provided therein.

Terms used herein are used only in order to describe an exemplary embodiment rather than limiting the present disclosure. In this case, singular forms include plural forms unless interpreted otherwise in context.

Electronic Device

FIG. 1 is a schematic view illustrating an embodiment of a coil component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN ET)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USB) 2.0/3.0 a high definition multimedia interface (HDMI), a CAM, and the like, may be used. In this case, various kinds of coil components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 (not shown) may be used to remove noise of power and signal lines or remove a high frequency ripple. Further, the bead 4 (not shown) for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, or a smartwatch. The electronic device may also be various other electronic devices well-known to those skilled in the art, in addition to the devices described above.

Coil Component

Hereinafter, an electronic component according to the present disclosure, for convenience, a coil component will be described. However, the electronic component according to the present disclosure is not necessarily limited to only the coil component, but may also be applied to other passive components such as a capacitor, and the like.

Meanwhile, herein, a side portion is used to refer to a direction toward a first direction or a second direction for convenience, an upper portion is used to refer to a direction toward a third direction for convenience, and a lower portion is to refer to a direction toward an opposite direction to the third direction for convenience. In addition, a length direction is used to refer to the first direction, a width direction is used to refer to the second direction, and a height or thickness direction is used to refer to the third direction. In addition, "positioned on the side portion, above, or below" conceptually includes a case in which a target component is positioned in a corresponding direction, but does not be in direct contact with a reference component, as well as a case in which the target component is in direct contact with the reference component in the corresponding direction. However, these directions are defined for convenience of explanation, and the claims are not particularly limited by the directions defined as described above.

Figure 2:
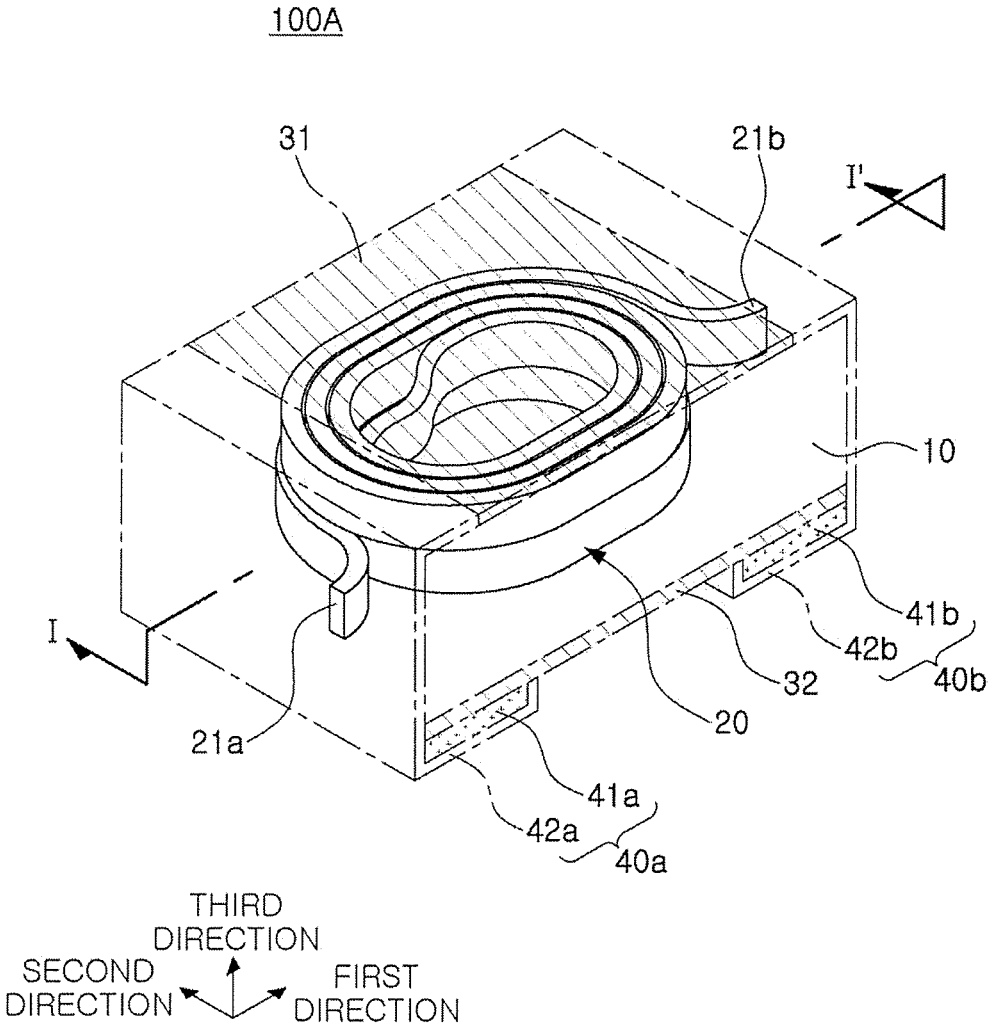
FIG. 2 is a schematic perspective view illustrating an embodiment of a coil component.

FIG. 2 is a schematic perspective view illustrating an embodiment of a coil component.

Figure 3:
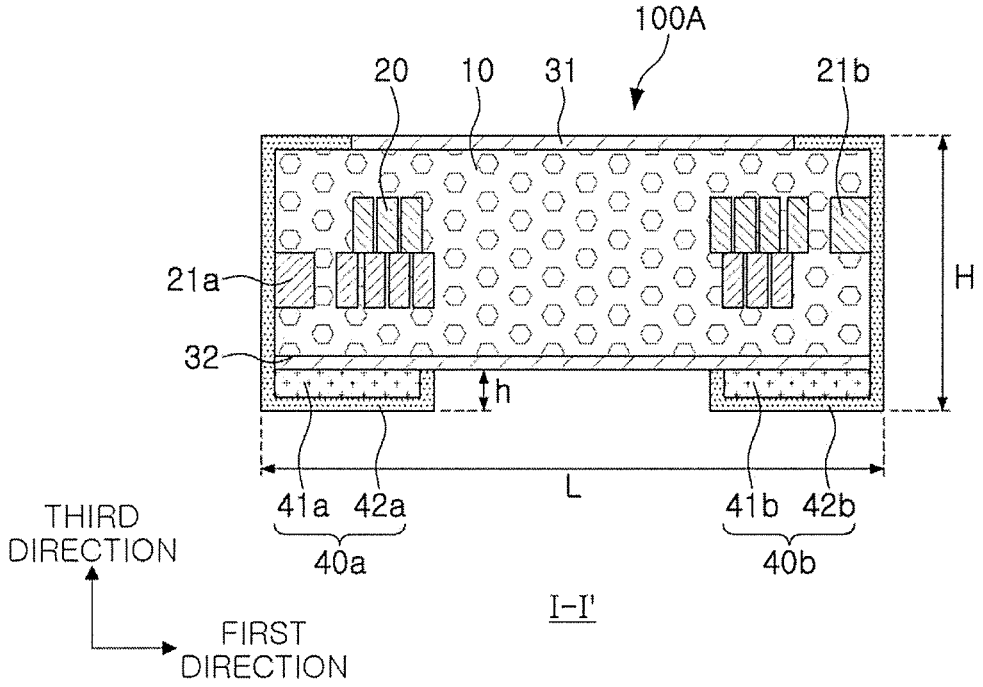
FIG. 3 is a cross-sectional view taken along line I-I' of the coil component of FIG. 2.

FIG. 3 is a cross-sectional view taken along line I-I' of the coil component of FIG. 2.

Figure 6:
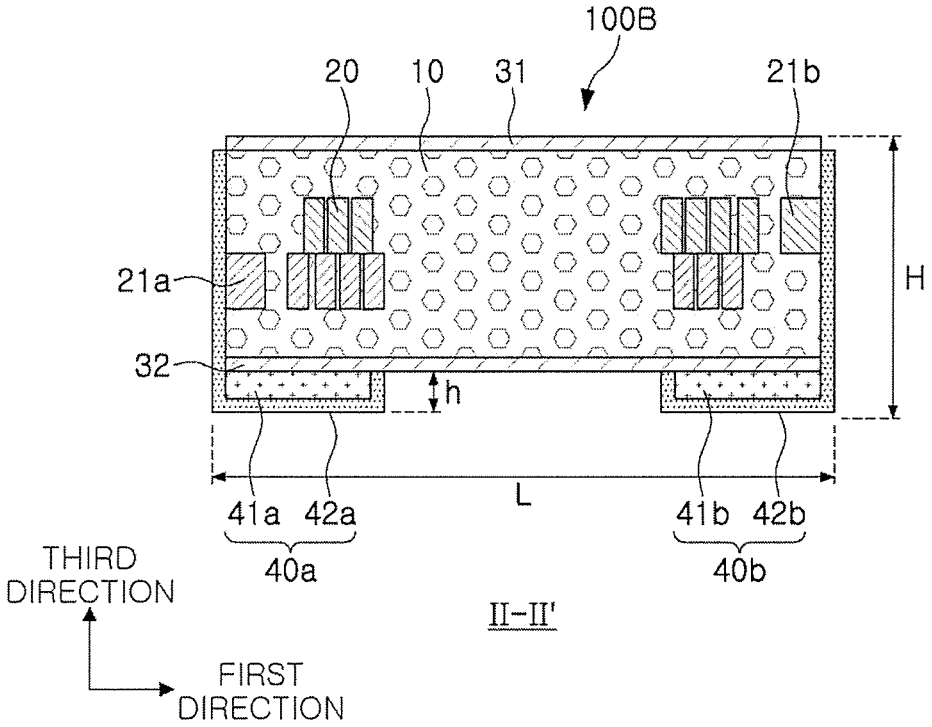
FIG. 6 is a cross-sectional view taken along line II-II' of the coil component of FIG. 5.

Referring to FIGS. 2 and 3, a coil component 100A according to an exemplary embodiment in the present disclosure may include a body 10 having an internal electrode 20 disposed therein and first and second external electrodes 40*a* and 40*b* disposed on the body 10 and connected to the internal electrode 20. In this case, in a cross section of the body 10 cut in the length and thickness directions of the body 10, the first and second external electrodes 40*a* and 40*b* may include first electrode layers 41*a* and 41*b* disposed below the body 10 and second electrode layers 42*a* and 42*b*, respectively. The second electrode layers 42*a* and 42*b* cover the first electrode layers 41*a* and 41*b* and at least side portions of the body 10, respectively. In addition, end portions 21*a* and 21*b* of the internal electrode 20 may be connected to the second electrode layers 42*a* and 42*b* through the respective side portions of the body 10, respectively. In some embodiments, end portions 21*a* and 21*b* of the internal electrode 20 may be directly connected to or contact the second electrode layers 42*a* and 42*b* through the respective side portions of the body 10, respectively. In addition, a first insulating layer 32 may be disposed between a lower surface of the body 10 and the first electrode layers 41*a* and 41*b*, and a second insulating layer 31 may be disposed on an upper surface of the body 10. In addition, a lower surface of the first insulating layer 32 and a lower surface of each of the second electrode layers 42*a* and 42*b* may be spaced apart from each other by a predetermined interval h (FIG. 6). At least a portion, for example, a central portion, of the upper surface of the body 10 may be covered with the second insulating layer 31, and at least other portions, that is, both sides of the central portion, of the upper surface of the body 10 may be covered with the second electrode layers 42*a* and 42*b*, respectively. Meanwhile, the second insulating layer 31 may be in contact with the second electrode layers 42*a* and 42*b*. The side surfaces of the second electrode layers 42*a* and 42*b* along a thickness direction of the second electrode layers 42*a* and 42*b* contact the side surface of the second insulating layer 31 along the thickness direction of the second insulating layer 31. In another embodiment (not shown), a major surface of the second electrode layer 42*a* or 42*b* contacts a major surface of the second insulating layer 31.

Figure 8A:
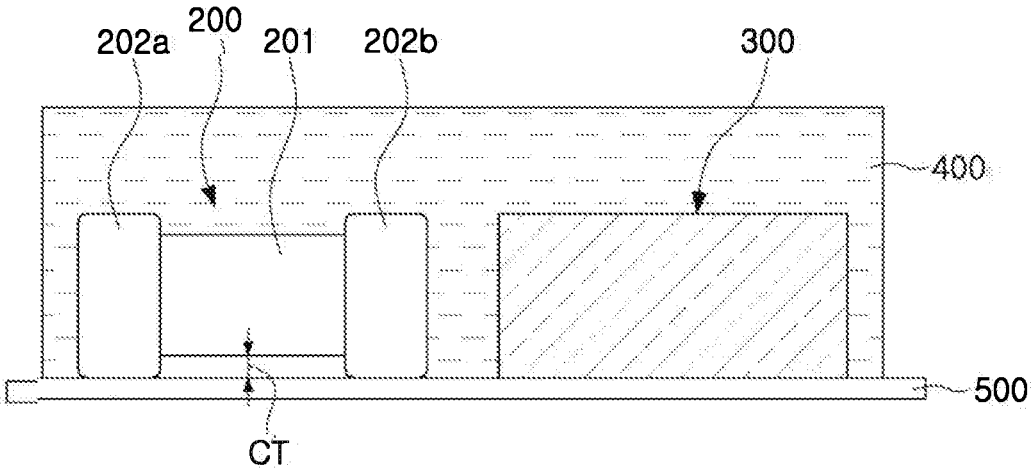
FIG. 8A Prior Art
FIGS. 8A and 8B are schematic views illustrating a problem of EMC wetting insufficiency.
Figure 8B:
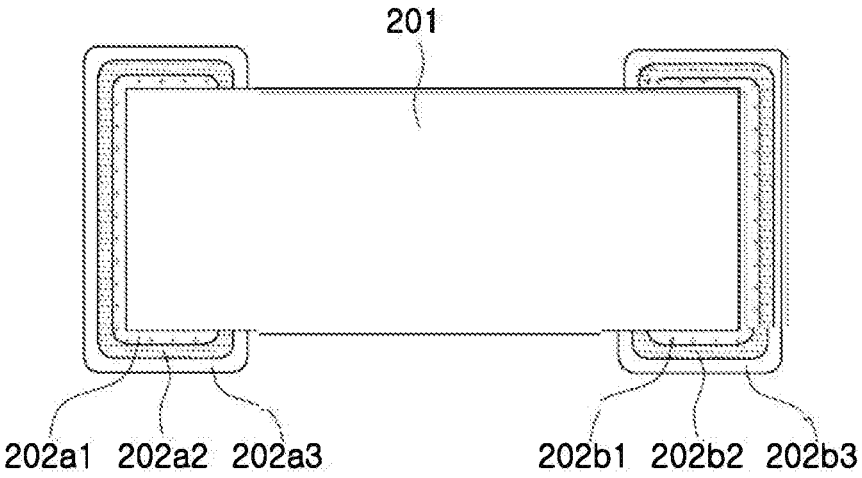
FIG. 8B Prior Art

Meanwhile, as illustrated in FIGS. 8A and 8B, when a (3.2×2.5 mm) inductor 200 having a large length in a longitudinal direction is surface-mounted on a printed circuit board (PCB) 500 and is then molded together with an integrated circuit (IC) 300 by an epoxy molding compound (EMC) 400, an interval CT of 30 μm to 40 μm generally exists between a bottom surface of each of external electrodes 202*a* and 202*b* of the inductor 200 and a bottom surface of a body 201 of the inductor 200. In this case, molding epoxy is not sufficiently filled in an interval CT between the inductor 200 and the PCB 500, such that an internal crack of the inductor 200 may occur due to thermal contraction and expansion of the molding epoxy. In this case, an inductance of the inductor 200 may be rapidly decreased. In order to sufficiently apply the EMC 400 into the gap having the interval CT between the external electrodes 202*a* and 202*b* and the body 201 of the inductor 200, it is required to secure a minimum distance CT of approximately 60 μm or more between a bottom surface of the body 201 of the inductor 200 and a top surface of the PCB 500. However, in the inductor 200 illustrated in FIGS. 8A and 8B, the external electrodes 202*a* and 202*b* are simply formed in a sequence of thin layers including paste printing layers 202*a*1 and 202*b*1, first plating layers 202*a*2 and 202*b*2, and second plating layers 202*a*3 and 202*b*3, respectively, and it is thus impossible to secure an interval CT of 40 μm or more. When thicknesses of the first plating layers 202*a*2 and 202*b*2 and the second plating layers 202*a*3 and 202*b*3 are increased, the interval CT may be increased, but a thickness of each of the external electrodes 202*a* and 202*b* is generally increased as much, especially the thickness of the external electrode on the side surface of the body of the inductor, and volume efficiency of the body 201 in relation to the inductor 200 having the same size is thus decreased.

On the other hand, in the coil component 100A in FIG. 2 according to the exemplary embodiment, the first electrode layers 41*a* and 41*b* may exist below the body 10, and the first electrode layers 41*a* and 41*b* and the side portions of the body 10 may be covered with the second electrode layers 42*a* and 42*b*, respectively. In this case, even though the first insulating layer 32 and the second insulating layer 31 are disposed on the lower and upper portions of the body 10, respectively, in order to give an insulation property, the interval h described above in FIG. 3 may be sufficiently increased to 60 μm or more. Nevertheless, only the second electrode layers 42*a* and 42*b* are formed on the side portions of the body 10, and a thickness may thus be maintained at 30 μm or less, resulting in a reduced thickness of the external electrode on the side surface of the body and a significant increase in volume efficiency of the body 10. That is, an internal crack problem of the coil component 100A may be solved by increasing the interval h to improve an interface close adhesion between the coil component 100A and the PCB after the coil component 100A is mounted on the PCB, or the like, while significantly increasing the volume efficiency of the body 10.

The respective components of the coil component 100A according to the exemplary embodiment will hereinafter be described in more detail with reference to the drawings.

The body 10 may form an appearance of the coil component 100A, and may have first and second surfaces opposing each other in the first direction, third and fourth surfaces opposing each other in the second direction, and fifth and sixth surfaces opposing each other in the third direction. Hereinafter, the first and second surfaces will be referred to as end surfaces of the body 10, and the third and fourth surfaces will be referred to as side surfaces of the body 10, and the fifth and sixth surfaces will be referred to as lower and upper surfaces of the body 10. The body 10 may have a hexahedral shape, but is not limited thereto. The body 10 may include a magnetic material. The magnetic material is not particularly limited as long as it has a magnetic property, and may be, for example, Fe alloys such as pure iron powders, Fe—Si-based alloy powders, Fe—Si—Al-based alloy powders, Fe—Ni-based alloy powders, Fe—Ni—Mo-based alloy powders, Fe—Ni—Mo—Cu-based alloy powders, Fe—Co-based alloy powders, Fe—Ni—Co-based alloy powders, Fe—Cr-based alloy powders, Fe—Cr—Si-based alloy powders, Fe—Ni—Cr-based alloy powders, Fe—Cr—Al-based alloy powers, or the like, amorphous alloys such as an Fe-based amorphous alloy, a Co-based amorphous alloy, or the like, spinel type ferrites such as Mg—Zn-based ferrite, Mn—Zn-based ferrite, Mn—Mg-based ferrite, Cu—Zn-based ferrite, Mg—Mn–Sr-based ferrite, Ni—Zn-based ferrite, or the like, hexagonal ferrites such as Ba—Zn-based ferrite, Ba—Mg-based ferrite, Ba—Ni-based ferrite, Ba—Co-based ferrite, Ba—Ni—Co-based ferrite, or the like, or garnet ferrites such as Y-based ferrite, or the like.

The magnetic material of the body 10 may be a magnetic material-resin composite in which metal magnetic powders and a resin mixture are mixed with each other. The metal magnetic powders may include iron (Fe), chromium (Cr), or silicon (Si) as main components. For example, the metal magnetic powders may include iron (Fe)—nickel (Ni), iron (Fe), iron (Fe)—chromium (Cr)—silicon (Si), or the like, but are not limited thereto. The resin mixture may include epoxy, polyimide, liquid crystal polymer (LCP), or the like, but is not limited thereto. The metal magnetic powders may be metal magnetic powders having at least two average particle sizes. That is, the metal magnetic powders may have a bimodal or more form. When bimodal or trimodal metal magnetic powders are used, a packing factor may be increased.

The internal electrode 20 may be a winding type coil 20 having a first lead terminal 21*a* and a second lead terminal 21*b*, but is not limited thereto. That is, the internal electrode 20 may be modified depending on a kind of coil component 100A. The coil 20 may implement coil characteristics of the coil component 100A. The coil 20 may be a winding coil including a plurality of layers, and the respective layers of the winding coil may have a plurality of turns. That is, the respective layers of the winding coil may have a planar spiral shape. However, the coil 20 is not limited thereto, but may also be another type of winding coil. The coil 20 may have the first and second lead terminals 21*a* and 21*b*, and the end portions of the first and second lead terminals 21*a* and 21*b* may be exposed, respectively, through both end surfaces of the body 10, for example, the first surface and the second surface of the body opposing each other in the first direction. The coil 20 may be manufactured using a copper (Cu) wire, but is not limited thereto.

The insulating layers 31 and 32 may be disposed on the upper and lower surfaces of the body 10, respectively, to give an insulation property. The insulating layers 31 and 32 may be used as plating preventing layers. The insulating layers 31 and 32 may be formed by printing insulating materials on the upper and lower surfaces of the body 10, respectively. A material of each of the insulating layers 31 and 32 may be a glass-based material, an insulating resin, plasma, or the like, but is not limited thereto. The first insulating layer 32 may be disposed on the lower surface of the body 10 and the first electrode layers 41*a* and 41*b*. The second insulating layer 31 may be disposed on the upper surface of the body 10. At least a portion, that is, a central portion, of the lower surface of the first insulating layer 32 may be exposed. In addition, the lower surface of the first insulating layer 32 and the lower surface of each of the second electrode layers 42*a* and 42*b* may have the predetermined interval h therebetween. At least a portion, that is, a central portion, of the upper surface of the body 10 may be covered with the second insulating layer 31, and at least other portions, that is, both sides of the central portion, of the upper surface of the body 10 may be covered with the second electrode layers 42*a* and 42*b*, respectively. Meanwhile, although not illustrated in the drawings, insulating layers may also be formed in various shapes on the third and fourth surfaces of the body 10, if necessary.

The external electrodes 40*a* and 40*b* may serve to electrically connect the coil component 100A and an electronic device to each other when the coil component 100A is mounted in the electronic device. The external electrodes 40*a* and 40*b* may include the first electrode layers 41*a* and 41*b* formed on the lower surface, that is, the fifth surface, of the body 10, to be spaced apart from each other, and the second electrode layers 42*a* and 42*b* each covering the first electrode layers 41*a* and 41*b* and each extended to and covering opposite end surfaces, that is, the first and second surfaces, of the body 10, respectively. The second electrode layers 42*a* and 42*b* may also be extended to the upper surface, that is, the sixth surface, of the body 10 to cover at least portions of the upper surface of the body 10. Therefore, the total number of electrode layers 41*a*, 41*b*, 42*a*, and 42*b* formed below the body 10 may be more than that of electrode layers 42*a* and 42*b* formed on the side portions of the body 10, and a total thickness of the electrode layers 41*a*, 41*b*, 42*a*, and 42*b* formed below the body 10 may also be greater than that of the electrode layers 42*a* and 42*b* formed on the side portions of the body 10. When the external electrodes 40*a* and 40*b* are formed as described above, the interval h may be increased to 60 μm or more while an entire thickness H and an entire length L of the coil component 100A being maintained. Meanwhile, although not illustrated in the drawings, the second electrode layers 42*a* and 42*b* may also be at least partially extended to opposite side surfaces, that is, the third and fourth surfaces, of the body 10, if necessary, to cover the opposite side surfaces, but may not be extended to the opposite side surfaces. The first electrode layers 41*a* and 41*b* may be formed using paste including conductive particles such as silver (Ag). That is, the first electrode layers 41*a* and 41*b* may be paste printing layers. A binder resin of the paste may be an epoxy resin, a polyimide resin, or the like. The binder resin may be particularly an epoxy resin, but is not limited thereto. The second electrode layers 42*a* and 42*b* may be plating layers plated using copper (Cu), nickel (Ni), tin (Sn), or the like. The second electrode layers 42*a* and 42*b* may include, for example, first plating layers including copper (Cu) and second plating layers formed on the first plating layers and including nickel (Ni) and tin (Sn), respectively. The second plating layers including nickel (Ni) and tin (Sn) may be layers including alloys of nickel (Ni) and tin (Sn) or layers formed by sequentially plating nickel (Ni) and tin (Sn).

Figure 4:
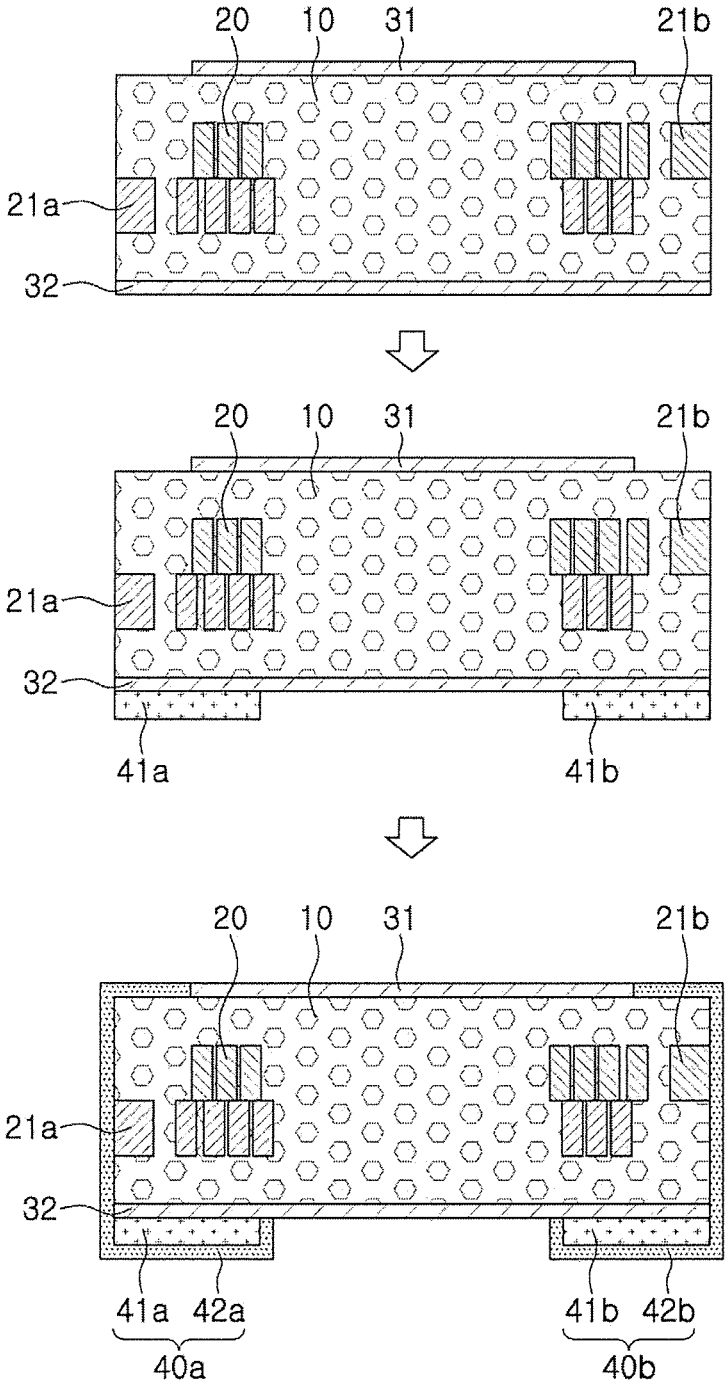
FIG. 4 is schematic views illustrating an example of processes of manufacturing the coil component of FIG. 3.

Referring to FIG. 4, the insulating layers 31 and 32 may be formed, respectively, on the upper and lower surfaces of the body 10 having the coil 20 disposed therein. The insulating layers 31 and 32 may be formed by printing insulating materials, but are not limited thereto. Then, the first electrode layers 41*a* and 41*b* may be formed on the lower surface of the body 10. The first electrode layers 41*a* and 41*b* may be formed using paste including conductive particles such as silver (Ag). Then, the second electrode layers 42*a* and 42*b* may be formed on the first electrode layers 41*a* and 41*b* and on the side surfaces and portions of the upper surface of the body 10, respectively. The second electrode layers 42*a* and 42*b* may be formed by plating using copper (Cu), nickel (Ni), tin (Sn), or the like. For example, the second electrode layers 42*a* and 42*b* may be formed by plating copper (Cu) and then plating alloys of nickel (Ni) and tin (Sn) or by sequentially plating nickel (Ni) and tin (Sn). Resultantly, the external electrodes 40*a* and 40*b* may be formed.

Figure 5:
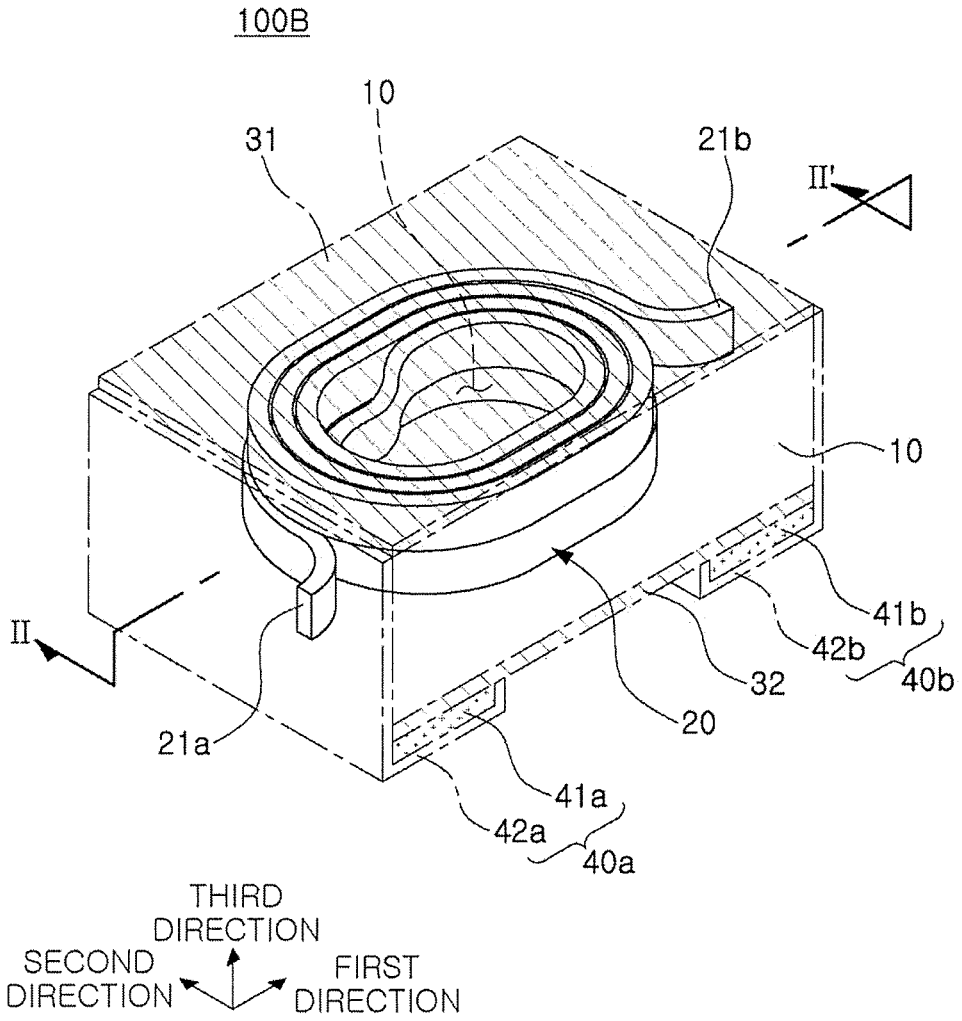
FIG. 5 is a schematic perspective view illustrating another embodiment of a coil component.

FIG. 5 is a schematic perspective view illustrating another embodiment of a coil component.

FIG. 6 is a cross-sectional view taken along line II-II' of the coil component of FIG. 5.

Referring to FIGS. 5 and 6, in a coil component 100B according to another exemplary embodiment in the present disclosure, a second insulating layer 31 may cover the entirety of an upper surface of a body. That is, second electrode layers 42*a* and 42*b* may not be extended to the upper surface of the body 10. A description of other structures or forms overlaps that described above, and is thus omitted. Also in this case, the effect as described above may be achieved.

Figure 7:
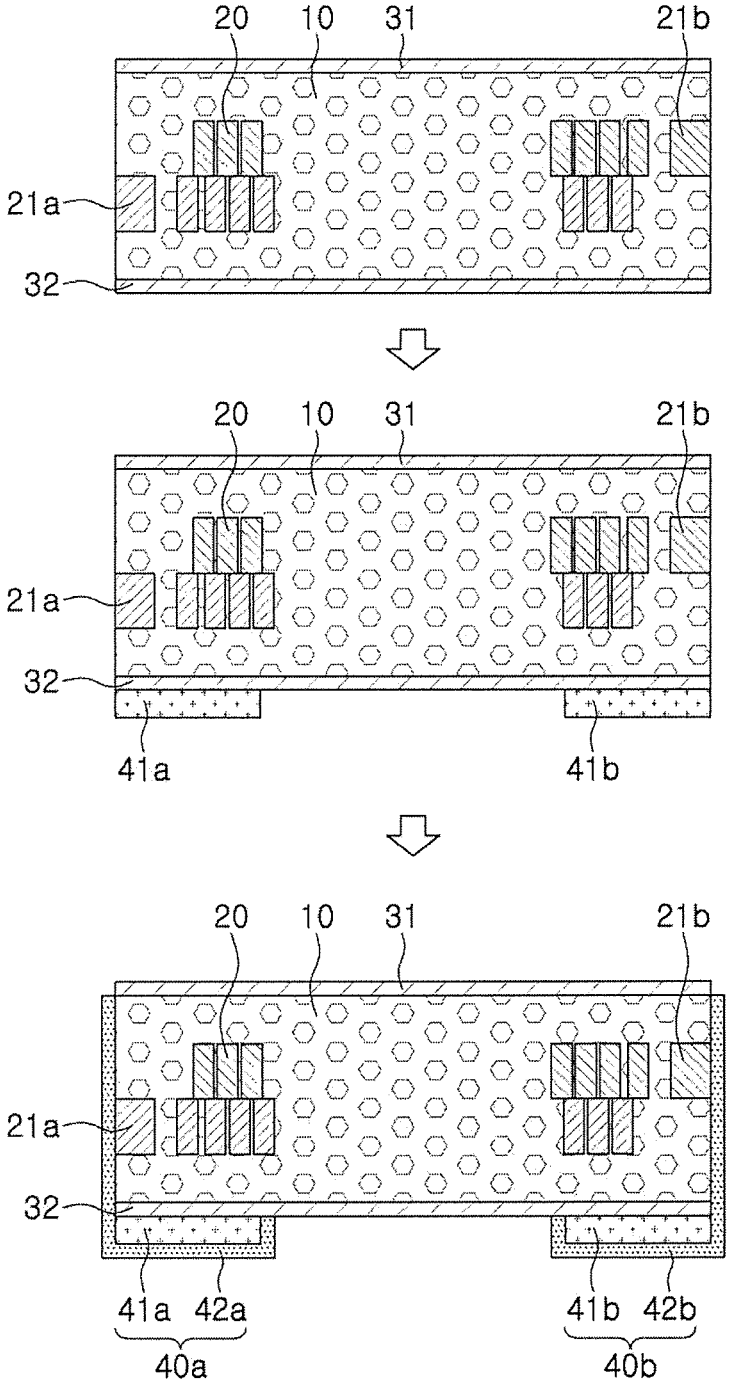
FIG. 7 is schematic views illustrating an embodiment of processes of manufacturing the coil component of FIG. 6.

FIG. 7 is schematic views illustrating an example of processes of manufacturing the coil component of FIG. 6.

Referring to FIG. 4, the insulating layers 31 and 32 may be formed, respectively, on the upper and lower surfaces of the body 10 having the coil 20 disposed therein. The insulating layers 31 and 32 may be formed by printing insulating materials, but are not limited thereto. Then, the first electrode layers 41*a* and 41*b* may be formed on the lower surface of the body 10. Then, the second electrode layers 42*a* and 42*b* may be formed on the first electrode layers 41*a* and 41*b* and on the side surfaces of the body 10, respectively. Resultantly, the external electrodes 40*a* and 40*b* may be formed. A description of other configurations overlaps that described above, and is thus omitted. Also in this case, the effect as described above may be achieved.

As set forth above, according to the exemplary embodiments in the present disclosure, an electronic component of which an interface close adhesion in a package is improved after the electronic component is mounted on a substrate such as a printed circuit board since a thickness of an external electrode on a surface of the electronic component mounted on the printed circuit board may be sufficiently secured and an increase in a size of the electronic component may be prevented may be provided.

While exemplary embodiments have been shown and described above, it will be apparent to those skilled in the art that modifications and variations could be made without departing from the scope of the present invention as defined by the appended claims.

What is claimed is:

1. An electronic component comprising:

a body having an internal electrode disposed therein; and an external electrode disposed on the body and connected to the internal electrode, wherein in a cross section of the body cut in length and thickness directions of the body, the external electrode includes a first electrode layer disposed below the body and a second electrode layer covering at least the first electrode layer and a side portion of the body, the internal electrode is connected to the second electrode layer through the side portion of the body, the first electrode layer and second electrode layer define an electrode stacked-structure in the thickness direction disposed on a first surface of the body, a second surface of the body opposing the first surface in the thickness direction is devoid of an electrode stacked-structure in the thickness direction, the side portion includes a third surface of the body from which the internal electrode is exposed and which is devoid of an electrode stacked-structure in the length direction, a first insulating layer is disposed between the first surface of the body and the first electrode layer, and the second electrode layer extends in the thickness direction to contact a side surface of the first insulating layer.

2. The electronic component of claim 1, wherein in the cross section of the body cut in the length and thickness directions of the body, the total number of electrode layers formed below the body is more than that of electrode layers formed on the side portion of the body.

3. The electronic component of claim 1, wherein in the cross section of the body cut in the length and thickness directions of the body, a total thickness of the electrode layers formed below the body is greater than that of the electrode layers formed on the side portion of the body.

4. The electronic component of claim 1, wherein the first electrode layer includes a paste printing layer including silver (Ag).

5. The electronic component of claim 1, wherein the internal electrode is a winding type coil having at least one lead terminal, and the electronic component is a winding type inductor.

6. The electronic component of claim 1, further comprising:

a second insulating layer disposed on the second surface of the body, wherein at least a portion of a lower surface of the first insulating layer is exposed.

7. The electronic component of claim 6, wherein the lower surface of the first insulating layer and a lower surface of the second electrode layer are spaced apart from each other by a predetermined interval.

8. The electronic component of claim 7, wherein the interval is 60 μm or more.

9. The electronic component of claim 6, wherein at least a portion of the second surface of the body is covered with the second insulating layer, and at least another portion of the second surface of the body is covered with the second electrode layer.

10. The electronic component of claim 9, wherein the second insulating layer and the second electrode layer are in contact with each other.

11. The electronic component of claim 6, wherein the second surface of the body is only covered with the second insulating layer.

12. The electronic component of claim 1, wherein the second electrode layer includes a first plating layer including copper (Cu).

13. The electronic component of claim 12, wherein the second electrode layer further includes a second plating layer formed on the first plating layer and including nickel (Ni) and tin (Sn).

14. The electronic component of claim 12, wherein the second electrode layer further includes a second plating layer formed on the first plating layer and including nickel (Ni) and a third plating layer formed on the second plating layer and including tin (Sn).

15. An electronic component comprising:

a magnetic body having first and second surfaces opposing each other in a first direction, third and fourth surfaces opposing each other in a second direction, and fifth and sixth surfaces opposing each other in a third direction;

a winding type coil disposed in the magnetic body and having a first lead terminal led out to the first surface and a second lead terminal led out to the second surface;

a first electrode layer formed on the fifth surface;

a second electrode layer covering the first electrode layer and extended to at least the first surface;

a third electrode layer formed on the fifth surface to be spaced apart from the first electrode layer; and a fourth electrode layer covering the third electrode layer and extended to at least the second surface, wherein the first lead terminal is connected to the second electrode layer through the first surface, the second lead terminal is connected to the fourth electrode layer through the second surface, the first electrode layer and second electrode layer define an electrode stacked-structure in the third direction disposed on the fifth surface, the sixth surface is devoid of an electrode stacked-structure in the third direction, the first and second surfaces are devoid of an electrode stacked-structure in the first direction, an insulating layer is disposed between the fifth surface and at least one of the first electrode layer or the third electrode layer, and at least one of the second electrode layer or the fourth electrode layer extends in the third direction to contact a side surface of the insulating layer.

16. An electronic component comprising:

a body having an internal electrode disposed therein;

an external electrode disposed on the body and connected to the internal electrode; and a first insulating layer disposed between a lower surface of the body and the external electrode, wherein in a cross section of the body cut in length and thickness directions of the body, the external electrode includes a first electrode layer disposed only below the body and a second electrode layer covering at least the first electrode layer and a side portion of the body, the internal electrode is directly connected to the second electrode layer through the side portion of the body, a lower surface of the first insulating layer and a lower surface of the second electrode layer are spaced apart from each other by 60 μm or more, and the second electrode layer extends in the thickness direction to contact a side surface of the first insulating layer.

17. The electronic component of claim 16, further comprising:

a second insulating layer disposed on an upper surface of the body, wherein at least a portion of the lower surface of the first insulating layer is exposed.

18. The electronic component of claim 17, wherein at least a portion of the upper surface of the body is covered with the second insulating layer, and at least another portion of the upper surface of the body is covered with the second electrode layer.

19. The electronic component of claim 17, wherein the second insulating layer and the second electrode layer are in contact with each other.

20. The electronic component of claim 17, wherein the upper surface of the body is only covered with the second insulating layer.

* * * * *